US010077631B2

(12) United States Patent
Kucera et al.

(10) Patent No.: US 10,077,631 B2
(45) Date of Patent: Sep. 18, 2018

(54) PRESSURE EQUALIZING VALVE INSENSITIVE TO SETTING DEPTH AND TUBING PRESSURE DIFFERENTIALS

(71) Applicant: BAKER HUGHES INCORPORATED, Houston, TX (US)

(72) Inventors: Samuel C. Kucera, Tulsa, OK (US); Brett C. Jones, Broken Arrow, OK (US); Jason W. Edwards, Tulsa, OK (US)

(73) Assignee: Baker Hughes, a GE company, LLC, Houston, TX (US)

( * ) Notice: Subject to any disclaimer, the term of this patent is extended or adjusted under 35 U.S.C. 154(b) by 216 days.

(21) Appl. No.: 14/853,356

(22) Filed: Sep. 14, 2015

(65) Prior Publication Data

US 2017/0074068 A1 Mar. 16, 2017

(51) Int. Cl.
*E21B 34/10* (2006.01)

(52) U.S. Cl.
CPC ..... *E21B 34/101* (2013.01)

(58) Field of Classification Search
CPC ..... E21B 34/08; E21B 34/10; E21B 34/101; Y10T 137/86936; Y10T 137/86944; Y10T 137/86968
USPC ..... 137/629, 630, 630.13; 251/282, 325, 25
See application file for complete search history.

(56) References Cited

U.S. PATENT DOCUMENTS 4,289,165 A 9/1981 Fredd
4,415,036 A 11/1983 Carmody et al.
4,478,286 A 10/1984 Fineberg
4,629,002 A * 12/1986 Pringle ..... E21B 34/101 166/324
5,897,095 A * 4/1999 Hickey ..... E21B 34/10 138/31
7,182,139 B2 * 2/2007 Rayssiguier ..... E21B 23/04 166/374
7,743,833 B2 * 6/2010 Cascario ..... E21B 34/10 166/332.8
7,905,292 B2 * 3/2011 Beall ..... E21B 34/101 166/324
8,276,662 B2 * 10/2012 Niconoff ..... E21B 43/08 137/625.29
8,534,317 B2 9/2013 Plunkett et al.
8,534,361 B2 9/2013 Plunkett et al.
9,062,519 B2 6/2015 Kucera et al.
2011/0079394 A1 4/2011 Plunkett et al.
2011/0088906 A1 4/2011 Myerley
(Continued)

*Primary Examiner* — Cathleen R Hutchins
*Assistant Examiner* — Jonathan Malikasim
(74) *Attorney, Agent, or Firm* — Steve Rosenblatt

(57) ABSTRACT

An equalizer valve is hydraulically operated by a pair of control lines running from a remote location such as a well surface. The use of control lines to make a mandrel or piston move in opposed directions removes the need for a spring or compressed gas to act as a spring against the anticipated hydrostatic force in a single control line system that is dependent on setting depth. The equalizer valve with its pair of control lines is insensitive to setting depth. Three seals on the mandrel are used to move the mandrel with the two control lines in opposed directions and to apply a net force to the mandrel. The seal applying the net closure force is exposed to a low or atmospheric chamber to make the second seal operate reliably using a large differential.

14 Claims, 1 Drawing Sheet

(56) References Cited

U.S. PATENT DOCUMENTS

| | | | |
|---|---|---|---|
| 2012/0012327 | A1 | 1/2012 | Plunkett et al. |
| 2014/0190704 | A1 | 7/2014 | Kucera et al. |
| 2015/0083954 | A1 | 3/2015 | McEvoy et al. |

* cited by examiner

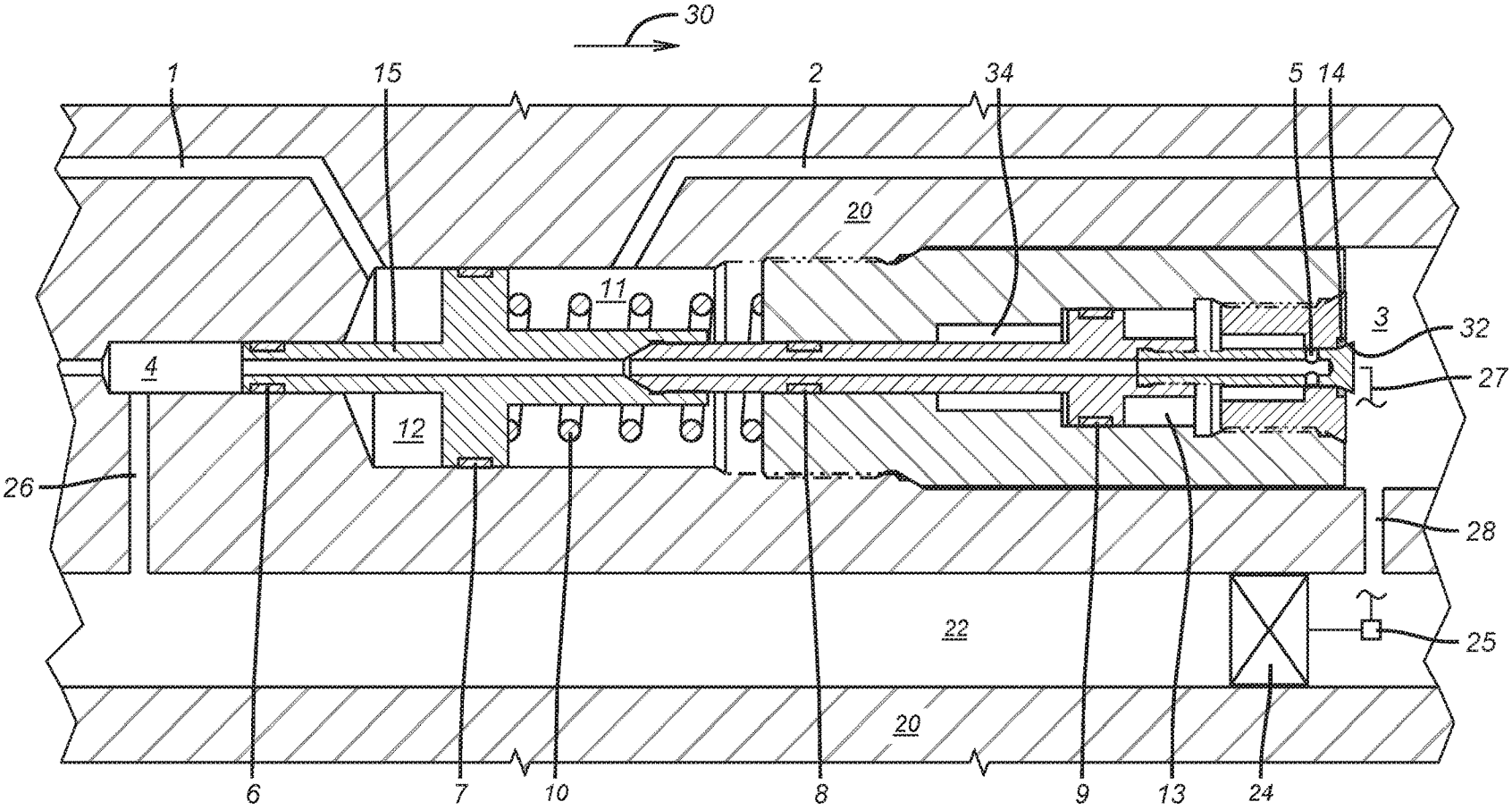
30
1
2
34
15
5
14
32
3
27
28
25
24
13
9
22
20
20
8
11
10
7
12
6
4
26

PRESSURE EQUALIZING VALVE INSENSITIVE TO SETTING DEPTH AND TUBING PRESSURE DIFFERENTIALS

FIELD OF THE INVENTION

The field of the invention is valves that equalize isolated zones that can be at different pressures. More particularly the valve of the present is insensitive to setting depth or internal string pressure variations on either of the opposed isolated zones. The valve remains closed when not actuated in either direction. The valve can function in tandem or independently along with the string barrier valve with which the equalizing valve is associated.

BACKGROUND OF THE INVENTION

Barrier valves or formation isolation valves or safety valves typically are used to keep one zone in a tubular string isolated from another. As a result such valves may see large differential pressure in the closed position. Equalizing valves have been developed to equalize pressure across a closed valve prior to trying to use the operating mechanism on the valve member. The reason for equalizing is that there is far less resistance on the operating mechanism for the valve when the pressure is equalized. Trying to operate the valve mechanism with a large differential pressure across it can distort or break the operating assembly making the valve immovable from the closed position or stuck part way open. Situations like this involve expensive fishing or milling operations to remove the inoperative valve.

Some designs use spring loaded poppets in flapper type safety valves such that when the flow tube descends it strikes the poppet first and opens a bypass passage around the flapper before the flow tube moves further and contacts the flapper to rotate it 90 degrees to the fully open position. Such designs are shown in U.S. Pat. No. 4,415,036 and U.S. Pat. No. 4,478,286. Other relevant prior art can be seen in U.S. Pat. No. 4,289,165; U.S. Pat. No. 8,534,361; US 20110088906 and U.S. Pat. No. 8,534,317. More recently and more relevant is U.S. Pat. No. 9,062,519 which is a design that is improved by the present invention. In this design there is a single control line 45 that pushes against a piston area 48 and against a return spring 50 to offset the hydrostatic pressure in the control line 45. In this design seal 18 has very low differential pressure that subjects it to leakage. Additionally, the size of the spring needed for deep setting depths makes the size of the device impractical for deployment in such depths. The present invention makes the equalizer valve insensitive to setting depth so that a specific spring does not need to be installed depending on the setting depth. Instead a pressure balanced two control line system is applied so that an external bias on an operating piston shaft is not needed although it could optionally be added.

In another aspect of the present invention, there are three seals that interact with the two line control system and a fourth seal that exerts a net closure force on the mandrel. That fourth seal is exposed to an atmospheric, or low, pressure on one side and upstream pressure on the opposite side ensuring optimum seal performance due to large differential pressure. Optionally, a spring can be used to overcome the friction of the seals in the system. These and other aspects of the present invention will be more readily apparent to those skilled in the art from a review of the detailed description of the preferred embodiment along with the associated drawing while recognizing that the full scope of the invention can be determined from the appended claims.

SUMMARY OF THE INVENTION

An equalizer valve is hydraulically operated by a pair of control lines running from a remote location such as a well surface. The use of control lines to make a mandrel or piston move in opposed directions removes the need for a spring or compressed gas to act as a spring against the anticipated hydrostatic force in a single control line system that is dependent on setting depth. The equalizer valve with its pair of control lines is insensitive to setting depth. Three seals on the mandrel are used to move the mandrel with the two control lines in opposed directions and to apply a net force to the mandrel. The seal applying the net closure force is exposed to a low or atmospheric chamber to make the second seal operate reliably using a large differential.

BRIEF DESCRIPTION OF THE DRAWING

The FIGURE is a schematic representation of an equalizer valve between opposed zones isolated by a tubing barrier valve.

DETAILED DESCRIPTION OF THE PREFERRED EMBODIMENT

The FIGURE schematically illustrates a tubular wall 20 not drawn to scale that defines a through passage 22 in which resides a valve or other isolation tool 24. Passages 26 and 28 respectively communicate upstream pressure zone 4 and downstream pressure zone 3 of passage 22 to opposite sides of closed valve 24.

Chamber 12 is defined between uphole seal 6 and operating seal 7 and outside of mandrel 15. Access to chamber 12 is from control line 1 such that pressure applied to control line 1 between uphole seal 6 and operating seal 7 creates a net force on the mandrel 15 in the direction of arrow 30. Mandrel 15 has a tapered end member 32 that seals against metal or (optionally) polymeric seat 14 unless the mandrel is pushed in the direction of arrow 30. Separation of the tapered valve member 32 from seat 14 allows pressure from downstream zone 3 to reach passage 5 through mandrel 15 by entering selectively sealed chamber 13 so that pressure can equalize between zones 3 and 4. On the other hand, pressure from balance control line 2 into chamber 11 pushes the mandrel 15 in a direction opposite arrow 30 and moves the tapered valve member 32 back against seat 14 for the closed position isolating zones 3 and 4 in which selectively sealed chamber 13 is again sealed.

Low pressure chamber 34 is defined between downhole seal 8 and net force applying seal 9 and outside mandrel 15. Net force applying seal 9 is larger than seals 6 or 8. Net force applying seal 9 also defines a selectively sealed chamber 13. The pressure in zone 4 communicates through a mandrel passage 5 to an outlet in selectively sealed chamber 13. With valve member 32 on seat 14 the zone 4 pressure pushes in the opposite direction of arrow 30 against the pressure in chamber 34. Since the pressure in chamber 34 is very low or at atmospheric the differential across net force applying seal 9 is great, on the order of 7000 PSIG or more, especially in very deep high pressure wells. Net force applying seal 9 seals more reliably due to the high pressure differentials. Seals 6 and 8 are preferably the same size and the hydrostatic pressure is the same in control lines 1 and 2. Therefore, the opposed forces on seal 6, 7, and 8 from chambers 11 and 12 are equal and opposite. Spring 10 can optionally be provided to offset friction in the various seals in a direction opposite arrow 30 or uphole. Alternatively spring 10 can apply a force in the direction of arrow 30 forcing the application of control line pressure to hold the bypass valve closed.

Optionally, the mandrel 15 can be a part of the actuation system comprising schematically illustrated link 27 connected to actuator 25 of valve 24 for the valve or other isolation tool 24. If no pressure is applied in lines 1 and 2 the default position of the mandrel 15 will be as shown in the FIG. due to the pressure in zone 4 communicating with selectively sealed chamber 13 to push uphole on seal 9 which is bigger than seal 6 getting an opposing downhole force on seal 6 from the pressure in zone 4. Apart from the above described net force, the fact that there is low or atmospheric pressure in chamber 34 adds further to the uphole force in a direction opposite arrow 30. Low pressure chamber 34 can have a compressed gas alone or a combination of gas and grease or some other fluid to promote sealing by seals 8 and 9. Spring 10, if used, bears against a shoulder associated with mandrel 15.

The present invention improves the device in U.S. Pat. No. 9,062,519 particularly when deep applications are contemplated. In deep applications the size of spring 50 in that patent would need to be so large or multiple springs could be needed to get the required force against hydrostatic in a one line system that it may be impractical to build the device at all. The use of a pair of control lines eliminates this issue but raises other issues addressed by the present invention. While pressure in line 1 or 2, if held, can retain mandrel 15 in one of opposed positions, there can be situations where no pressure is applied to lines 1 and 2 at any given time. The present invention provides a second seal independent from the one moved by the control lines to ensure equalizer closure. The large differential pressure on seal 9 combined with no pressure applied at lines 1 and 2 insures a good seal for seal 9 as compared to the design in U.S. Pat. No. 9,062,519 where the differential pressure on seal 18 without pressure applied in single control line 45 is at a minimum.

The above description is illustrative of the preferred embodiment and many modifications may be made by those skilled in the art without departing from the invention whose scope is to be determined from the literal and equivalent scope of the claims below:

We claim:

1. A pressure equalizing valve between an isolated uphole zone and a downhole zone comprising:

a selectively movable mandrel in a housing passage having a first and second control lines connected to a housing on opposed sides of an operating seal associated with said mandrel, said operating seal located between an uphole and a downhole seals associated with said mandrel and having a larger dimension than said uphole and downhole seals, such that pressure in said first control line enters a sealed uphole chamber during mandrel movement defined between said uphole seal and said operating seal and pressure in said second control line enters a sealed downhole chamber during mandrel movement defined between said downhole seal and said operating seal said uphole chamber sealingly isolated from said downhole chamber such that selective pressure in said first or second control lines moves said mandrel in opposed directions for selective contact of a valve member on said mandrel with a seat surrounding said passage;

a force applying seal larger than said uphole seal or said downhole seal, said force applying seal exposed on one side to the same pressure as one side of said uphole or said downhole seal to create a net force on said mandrel in the direction of holding said valve member to said seat.

2. The valve of claim 1, wherein:

said uphole and downhole chambers are in pressure balance from said control lines when no applied pressure in said control lines is present.

3. The valve of claim 1, wherein:

a bias force within said housing biases said mandrel to bring said valve member in contact with said seat or to move said valve member away from said seat.

4. The valve of claim 3, wherein:

said bias force is sized for overcoming seal friction between said mandrel and said passage.

5. The valve of claim 1, wherein:

said force applying seal defines a low pressure chamber that is sealed during mandrel movement from the uphole and the downhole zones.

6. The valve of claim 5, wherein:

said low pressure chamber containing a compressible fluid.

7. The valve of claim 5, wherein:

said low pressure chamber containing a lubricant.

8. The valve of claim 5, wherein:

said force applying seal defining an opposing chamber to said low pressure chamber, said opposing chamber selectively opened to the downhole zone when said valve member is moved off said seat.

9. The valve of claim 8, wherein:

said opposing chamber is communicated to the uphole zone.

10. The valve of claim 9, wherein:

said opposing chamber is communicated to said uphole zone through said mandrel.

11. The valve of claim 1, wherein:

said uphole and said downhole seals are the same size.

12. The valve of claim 1, wherein:

said movement of said valve member away from said seat equalizes pressure on opposed sides of an isolation valve in a tubular string before the isolation valve is opened.

13. The valve of claim 12, wherein:

movement of said mandrel by moving said valve member away from said seat opens the isolation valve in the tubular string.

14. The valve of claim 13, wherein:

said housing is integrated into a wall of the tubular string that houses the isolation valve.

* * * * *